United States Patent [19]

Hemming

[11] Patent Number: 5,008,960

[45] Date of Patent: Apr. 23, 1991

[54] NURSING GARMENT

[76] Inventor: Valda K. Hemming, 13329 Canyon Back Lane, Poway, Calif. 92064

[21] Appl. No.: 538,553

[22] Filed: Jun. 15, 1990

[51] Int. Cl.[5] ..... A41D 1/20; A41D 1/22

[52] U.S. Cl. ..... 2/104; 2/46

[58] Field of Search ..... 2/46, 48, 49 R, 50, 2/51, 52, 104, 91; 66/171

[56] References Cited

U.S. PATENT DOCUMENTS

| | | | |
|---|---|---|---|
| 1,497,756 | 6/1924 | Jones | 2/49 R |
| 2,417,888 | 3/1947 | Schuster | 2/104 |
| 2,665,426 | 1/1954 | Schmidt | 2/49 R |
| 2,727,239 | 12/1955 | Simon | 2/49 R |
| 2,793,367 | 5/1957 | Hart | 2/49 R |
| 2,804,626 | 9/1957 | Rossiter | 2/91 |
| 2,831,193 | 4/1958 | Terry | 2/46 |
| 2,914,771 | 12/1959 | Slavin | 2/48 |
| 2,955,293 | 10/1960 | Peterson | 2/49 R |
| 3,914,797 | 10/1975 | Stembridge | 2/49 R |
| 4,106,122 | 8/1978 | Dodd | 2/104 |
| 4,468,816 | 9/1984 | Kaufer | 2/104 |
| 4,567,611 | 2/1986 | Kendrick | 2/104 |
| 4,622,698 | 11/1986 | Heyman et al. | 2/49 R |
| 4,651,349 | 3/1987 | Heiler | 2/104 |
| 4,697,287 | 10/1987 | Rose | 2/104 X |
| 4,712,251 | 12/1987 | Cobble | 2/104 X |
| 4,797,953 | 1/1989 | Dameron | 2/104 |
| 4,924,528 | 5/1990 | Trombetti-Dickens | 2/49 R |

FOREIGN PATENT DOCUMENTS

| | | | |
|---|---|---|---|
| 0307715 | 3/1989 | European Pat. Off. | 2/52 |

*Primary Examiner*—W. C. Reynolds
*Assistant Examiner*—Jeanette E. Chapman
*Attorney, Agent, or Firm*—Ralph S. Branscomb

[57] ABSTRACT

A nursing garment has a close-knit upper portion which lies over the shoulder of the nursing mother, which extends down into an expanded, open-knit lower portion which covers the breast and at least part of the baby while nursing, so that the upper portion may be used for burping the baby, and the lower portion is sufficiently opaque to provide privacy to the mother, yet adequately open to allow sufficient ventilation for the baby. In one embodiment, the garment is provided with two sides to cover both breasts, and in another embodiment, a single side is covered, in which embodiment the upper edge of the upper edge of the upper, close-knit portion is weighted to securely maintain the garment in place over the mother's shoulder.

1 Claim, 1 Drawing Sheet

5
5
16
14
12
10
21

12
10

18
20
16

24
14
12
10
22

14
16

NURSING GARMENT

BACKGROUND OF THE INVENTION

In many societies, breast feeding is accepted as a natural part of life and women breast feed openly in public without causing any stir. Unfortunately, in the United States, although breast feeding is sometimes done in public as a matter of necessity, it is considered better form to do it privately.

When breast feeding in public, the mother will try to cover her breast and the baby with a blanket. However, this is sometimes awkward, and the blanket generally tends to slide down off of the mother and the baby as the baby wiggles, exposing the breast and the baby.

With increased interest in breast feeding babies, the formation of La Leche League, and with the current boomlet in babies, it would be very nice if mothers had some convenient means of nursing anywhere and anytime they wanted, while maintaining privacy and decorum in public.

SUMMARY OF THE INVENTION

The instant invention fulfills the above stated need by providing a specially designed nursing garment which is provided in two embodiments, either of which will maintain the garment securely in place over the breast and the baby while nursing. The garment provides a lower, relatively open-knit portion which covers the breast and the baby, and which is gathered at its top to pass into the close-knit upper portion which is used to burp the baby.

DETAILED DESCRIPTION OF THE PREFERRED EMBODIMENT

Figures 1, 2, 3, 4, 5:
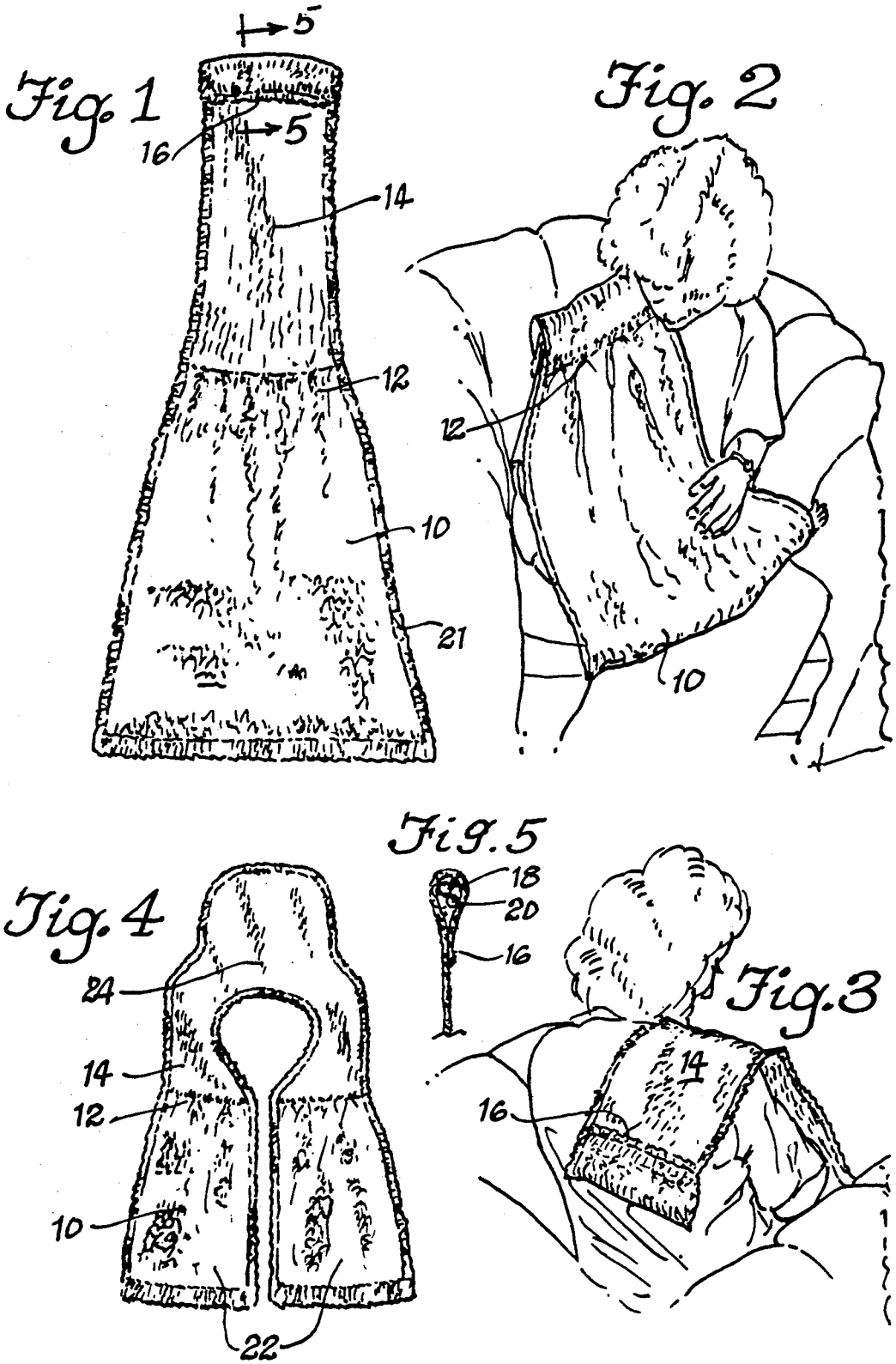
FIG. 1 is a front elevation view of the invention.
FIG. 2 is a perspective view illustrating the garment in use.
FIG. 3 is a perspective view of the rear side of a woman using the garment.
FIG. 4 is a front elevation view of the second embodiment of the invention.
FIG. 5 is a section taken along line 5—5 of FIG. 1.

The principle embodiment of the invention is shown in FIG. 1. The garment can be made from any suitable cloth, sewn together as indicated herein. The prototype and the initial product line are knit, so the description below will apply to the knitted embodiment, but the invention is by no means limited to knit blankets.

The entire garment is essentially made in one knitting process, and can be made on a knitting machine. The lower portion 10 of the garment is a loose, open weave so that when the garment is in use as shown in FIG. 2, the lower portion is over the breast and the baby, providing privacy for the mother and the baby, but at the same time permitting ample ventilation.

Toward the top of the lower portion, it is bunched as indicated at 12, and passes into the upper portion 14, which is a dense, close-knit, and relatively thick portion. This part of the garment is intended to burp the baby, and therefore must be thick enough to keep the wetness from passing through to the mother.

At the top of the upper portion, the knitting is folded over and sewn to itself at 16 to define a completely enclosed pocket. Inside the pocket there is a layer of padding 18, with weights 20 sewn into the padding. The weights that are currently used are of cumulative weight of about 2 ounces and are made of lead. Lead weights have an advantage in that they will not absorb water as would, for example, a sandbag. However, the perceived toxic qualities of lead might dictate a change in the composition of the weighting mass.

The entire garment is bordered by a trim 21. In the prototype units, the trim is added by hand as a separate process, whereas the rest of the garment is knit automatically on a relatively small knitting machine. However, a more sophisticated knitting machine could easily knit the entire garment including the trim, the produce a hand-made quality garment, with machine precision and efficiency.

In use, as shown in FIGS. 2 and 3, the mother throws the upper portion 14 of the garment over her shoulder, and the weights hold it in place, as shown. This is a very secure arrangement, and the mother can nurse indefinitely without fear that the garment will slip off.

A modification is shown in FIG. 4, in which basically the first embodiment has been duplicated to form a vest-like garment, with two sides 22, both with a dense upper portion and a loose lower portion, but instead of having a weighted top, the upper portion extends around the neck at 24 to form a vest. This has the advantage that either breast can be nursed, or they can be nursed alternately, without removing the garment. However, it is bulkier and slightly more difficult to use, which causes the first described embodiment to be the preferred one.

In use, a mother is now able to nurse in church, at the movies, at the bus station, at the airport, or any place else in public where the need arises, and the need generally arises fairly often due to the feeding habits of babies. The garment will be a blessing to any nursing mother who gets outside the house at all.

It is hereby claimed:

1. A nursing garment to cover the breast of a woman while nursing a baby, comprising:

(a) an absorbent upper portion for lying over the shoulder of a nursing woman;

(b) retaining means connected to the upper end of said absorbent portion for retaining same in place over the shoulder of the woman;

(c) an expanded lower portion connected to said upper portion to flair out to cover both the breast of the woman and at least a portion of the nursing baby;

(d) said upper portion and said lower portion being integrally knit, with said upper portion being close-knit and absorbent for burping the baby thereon and said lower portion expanding into a loose, open knit to provide adequate ventilation for the baby;

(e) said retaining means comprising weight means weighing on the order of two ounces sewn into the upper edge of said upper portion and being padded to provide a soft contact for the woman and baby.

* * * * *